US005439195A

United States Patent [19]

Jessee

[11] Patent Number: 5,439,195

[45] Date of Patent: Aug. 8, 1995

[54] TELEPHONE BOOK HOLDER

[76] Inventor: Fred W. Jessee, 164 Christie Park Manor SW., Calgary, Alberta, Canada, T3H 2T6

[21] Appl. No.: 127,493

[22] Filed: Sep. 28, 1993

[51] Int. Cl.[6] ..... B42D 17/00; B42D 17/01; A47B 97/04

[52] U.S. Cl. ..... 248/447; 248/293; 317/233

[58] Field of Search ..... 52/27.5, 36.5; 312/233, 312/313; 248/447, 447.1, 293, 281.1, 505, 460

[56] References Cited

U.S. PATENT DOCUMENTS

| | | | |
|---|---|---|---|
| 2,959,885 | 11/1960 | Upton | 248/447 |
| 3,028,701 | 4/1962 | Popper | 248/447 |
| 3,228,648 | 1/1966 | Tils | 312/233 X |
| 3,275,279 | 9/1966 | Caldwell | 312/233 X |
| 3,300,917 | 1/1967 | Bartley | 52/36.5 X |
| 3,338,002 | 8/1967 | Ericsson | 52/27.5 X |
| 3,508,803 | 4/1970 | Redick | 248/447 |
| 3,860,212 | 1/1975 | Nawman | 248/447 |
| 3,908,954 | 9/1975 | Nix | 248/447 |
| 3,918,672 | 11/1975 | Torn et al. | 248/447 |
| 4,184,725 | 1/1980 | Spangler | 312/233 |
| 4,254,929 | 4/1981 | Popper | 248/447 |
| 4,323,290 | 4/1982 | Hickman | 52/27.5 X |
| 4,335,659 | 6/1982 | Azzato et al. | 248/447 X |
| 4,460,145 | 7/1984 | Ando | 312/233 X |
| 4,583,708 | 4/1986 | Wieczorek | 248/447 |
| 4,616,298 | 10/1986 | Smeenge et al. | 248/293 X |
| 4,632,349 | 12/1986 | Anstey | 248/281.1 |
| 4,666,120 | 5/1987 | Popper | 312/233 X |
| 4,706,919 | 11/1987 | Soberalski | 248/293 X |

*Primary Examiner*—Carl D. Friedman
*Assistant Examiner*—Beth A. Aubrey

[57] ABSTRACT

A mechanical device comprising; a base (10) which attaches to typical furniture as found in public telephone locations. Base (10) has a hinge and a dashpot (14). Attached to the base by the hinge is a frame (12) and a piston (15) that interacts with dashpot (14). Piston (15) has a seal and valve (16) which control the interaction with dashpot (14). A typical binder with spring closing covers is fastened to frame (12). A rest (13), supports the binder when the binder is hinged forward and upward from below the furniture to a horizontal position, and opened.

3 Claims, 5 Drawing Sheets

TELEPHONE BOOK HOLDER

BACKGROUND-FIELD OF INVENTION

This invention relates to the storage and use of telephone directories located principally at public telephones.

BACKGROUND-DESCRIPTION OF PRIOR ART

The invention relates generally to devices for storage of and access to binders, and specifically to devices for enabling movement of a binder between stored and readable positions relative to a support. The most simple devices such as U.S. Pat. Nos. 3,860,212, 4,300,744 and U.S. Pat. No. 4,666,120 are difficult to use because they require two hands to use them. The user must support the weight of the binder and hold the assembly open at the same time. Because the binder is fastened to the shelf by it's back, both covers must be held by the user at the same time. Others such as U.S. Pat. Nos. 3,275,279, 4,323,290, and 3,918,672 have a great number of moving parts making them expensive to manufacture and maintain.

Weather is a factor in outside applications and this requires the use of rust proof metal such as stainless steel which is very expensive. The invention in U.S. Pat. No. 3,508,803 opens sideways in a difficult position to read. Presently these devices are designed to store directories below the shelves of telephone booths or enclosures and raised until they are within the confines of the enclosure. The sited binders cannot be opened fully because of the limitations of the enclosure. All of the devices are free to swing back to the storage position in an uncontrolled manor causing extra wear and tear.

SUMMARY OF THE INVENTION

The object of the invention is to provide convenient storage of directories in their binder beneath the shelf of telephone enclosures and to provide an inexpensive, weatherproof readily accessible method of raising the binder in such a way as to allow the enclosed directory to be fully opened and not restricted by the width of the enclosure.

A further object of the invention is to provide a rest that supports the weight of the directory and binder, allowing the user to hold the binder open with the minimal downward pressure of one hand. The unique rest combined with the inventions unique method of firmly holding the back cover in position makes this possible.

Another object is to provide a device that will automatically return to the storage position and having a means to prevent the binder and it's enclosed directory from returning to the storage position in an uncontrolled fashion.

The present invention is directed to store for convenient access, a binder which has rigid or semi-rigid hinged covers that enclose the contained directory and the covers are biased into the closed position by springs.

These and other objects are realized in accordance with the principles of the invention, broadly through a unique cooperation between the invention and the above described binder by which the directory normally is suspended beneath a service shelf, raises manually to a horizontal reading position clear of the shelf's edge where it can be completely opened and a slight downward pressure will maintain it, and on release, returns automatically to the storage position at a controlled speed.

In one illustrative embodiment of the invention, the binder with it's directory enclosed, is suspended below an enclosure shelf by the back cover of the binder and with the back of the binder substantially in the vertical position. A base with a hinge whose axis is parallel to the front of the shelf is attached below the shelf. A frame pivotally hinged from the base is firmly attached to the back cover of the binder.

There is a rest substantially in the centre of the shelf that protrudes away from the shelf towards the user. The frame is located so that when it's attached binder is raised to the horizontal position it is in close proximity to the rest and the front of the shelf. When the binder is open, the weight of the binder is supported by the rest.

The preferred embodiment of the base and frame are moulded plastic material. Integrally moulded to the base and frame is a sector shaped dashpot substantially located in the centre of the hinge with the opening of the dashpot at the centre axis of the hinge.

Access to the directory is provided by gripping the binder and pivoting same forward and upward until it is substantially in the horizontal position in front of the shelf. The binder can then be opened to access the directory. When the binder is opened, the back of the binder is above the rest. Light downward pressure on the front cover of the open binder maintains that position whereby the entire weight of the device is carried by the rest. Upon release of the pressure, the covers of the binder are biased to the closed position allowing gravity to return the binder to the storage position. The dash pot controls the speed of the return of the binder to the storage position.

Further objects and advantages of the holder are; they may be manufactured of plastic or plastic like materials. These materials are weather proof and rust proof and can be moulded economically to embody the hinge and control device. Still further objects and advantages will become apparent from consideration of the ensuing description and drawings.

A BRIEF DESCRIPTION OF DRAWINGS

These and other aspects of the invention will be better understood from the following description of an exemplary embodiment therereof, and from the accompanying drawings wherein.

DETAILED DESCRIPTION OF THE PREFERRED EMBODIMENT

Figure 3:
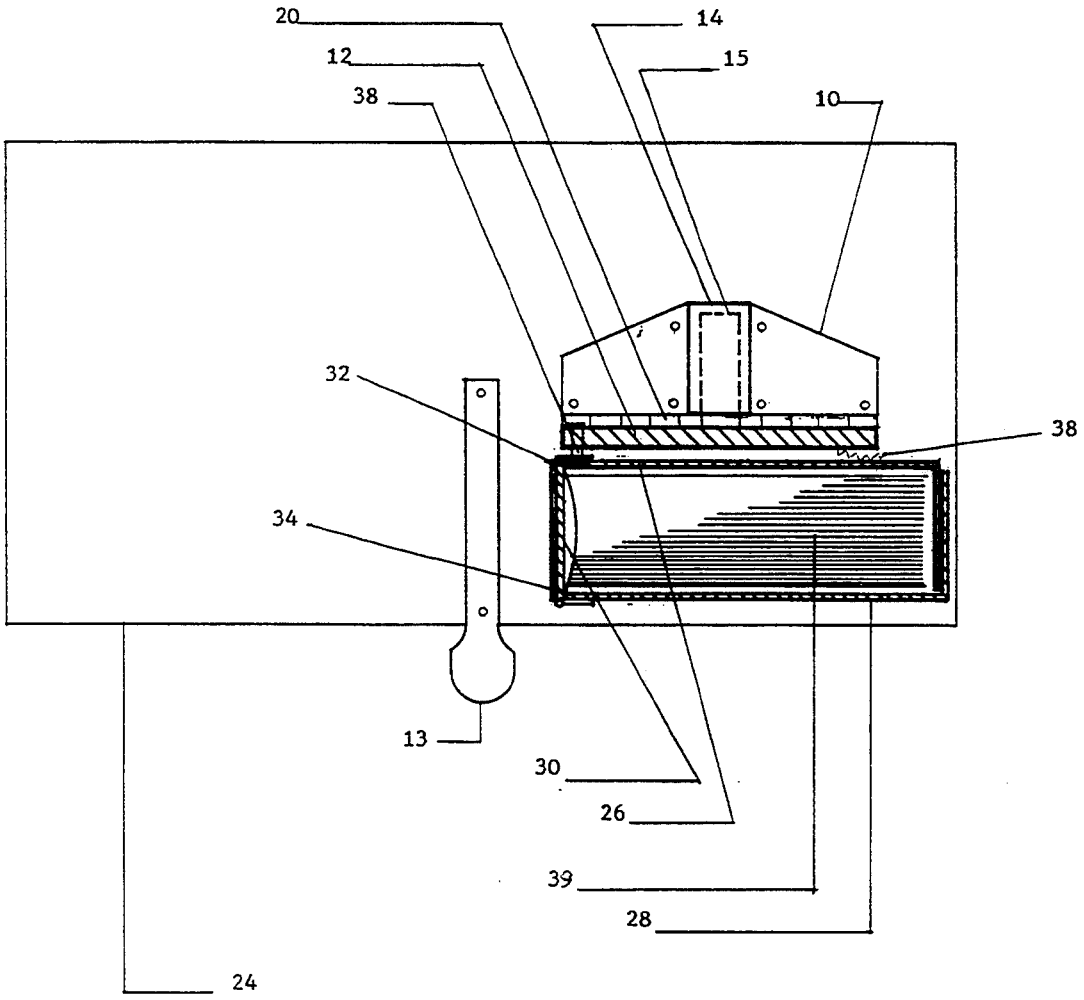
FIG 3 is a view of the bottom side of the shelf with the rest and with the holder and binder in the stored position.
Figure 4:
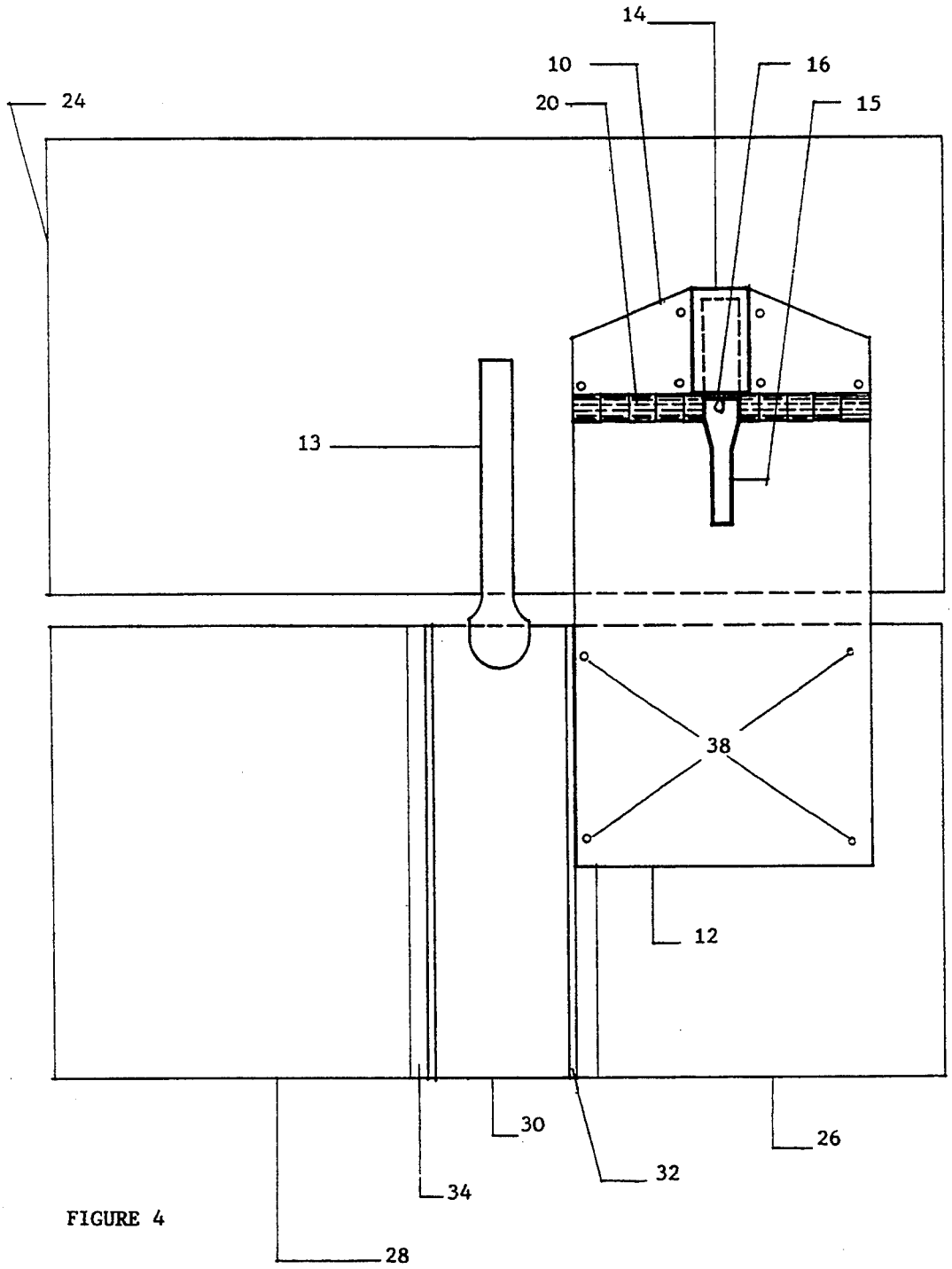
FIG. 4 is a view of the bottom side of the shelf with the rest and binder in the access position.
Figure 5:
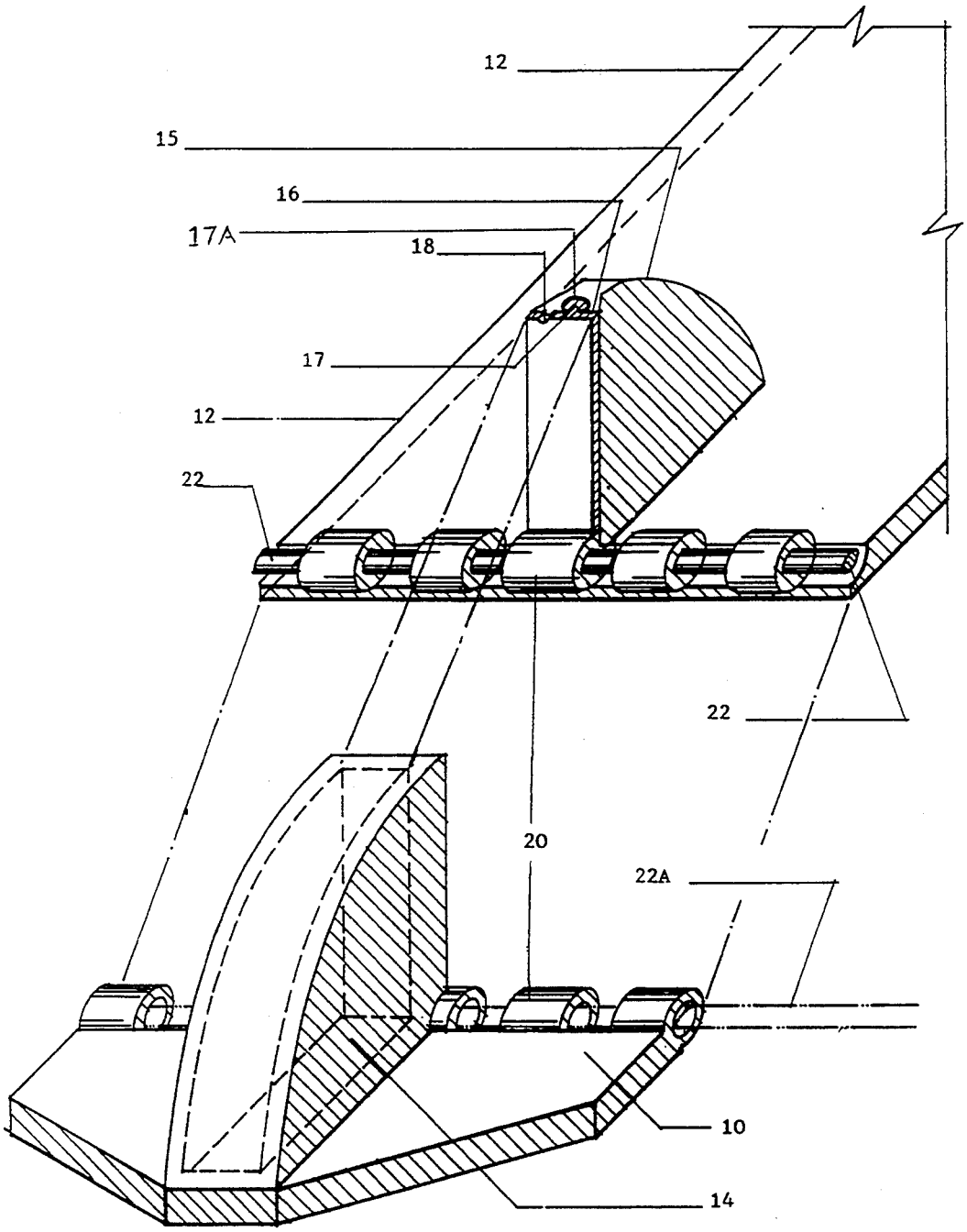
FIG. 5 is an exploded perspective view of the bottom side of the holder.

Refer first to FIGS. 1–4 a typical public telephone enclosure 23 with shelf 24 beneath which are base 10 and rest 13 attached thereto in a suitable manner. Base 10 has hinge 20 facing the front of the shelf and parallel to it. Pivotally mounted to base 10 is frame 12. Back cover 26 of binder 21 is fastened to frame 12 by fasteners 38 and is oriented with back 30 adjacent to one edge of frame 12 and at 90 degrees from hinge 20. Enclosed in Binder 21 is telephone directory 39. Binder 21 is typical of those presently in use with spring biased hinges 32 and 34 effecting closure of covers 26 and 28. Rest 13 is substantially centred on the front edge of shelf 24 and protruding towards the user far enough to support back 30 of binder 21. Illustrated in FIG. 5 are the details of the invention. Substantially in the centre of base 10 is an integrally moulded sector shaped dashpot 14 at 90 degrees to hinge 20. Substantially in the centre of frame 12 is an integrally moulded piston 15 at 90 degrees to hinge 20. Dashpot 14 and piston 15 interact pivotally around hinge 20. Seal 16 is made of flexible material such as urethane and is mounted on the face of piston 15 with tongue 17 in groove 17*a*. Tongue 17 is substantially centred longitudinally on the back of seal 16 and the tongue runs from one end of the seal to the other. Groove 17*a* on the face of piston 15 is located and designed to engage with tongue 17 so that seal 16 centrally locates in dashpot 14. Opening 18 provides a means to controls the passage of air out of dashpot 14.

Figure 1:
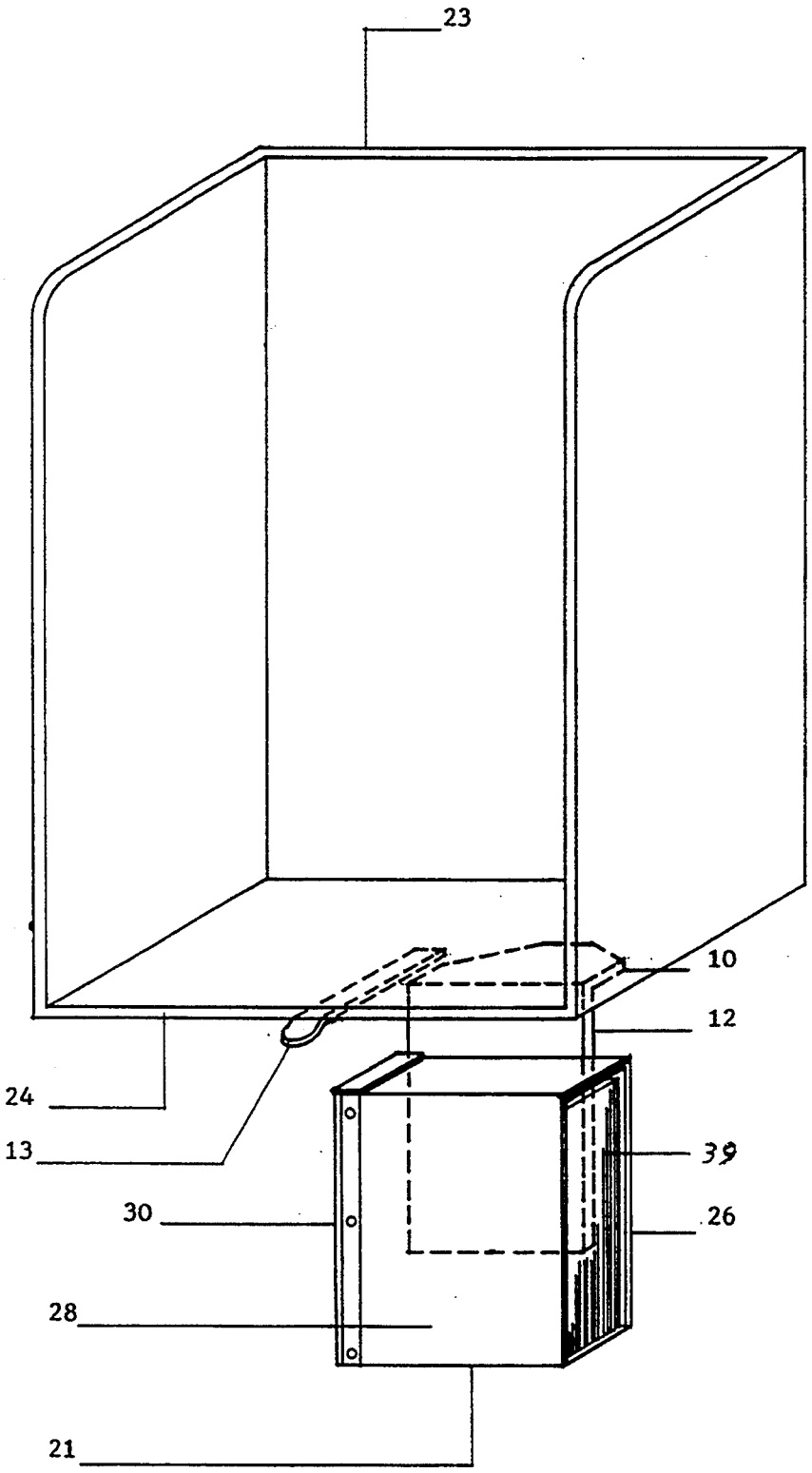
FIG. 1 is a perspective view of a payphone enclosure showing the holder and rest in the storage position below the shelf of the enclosure.
Figure 2:
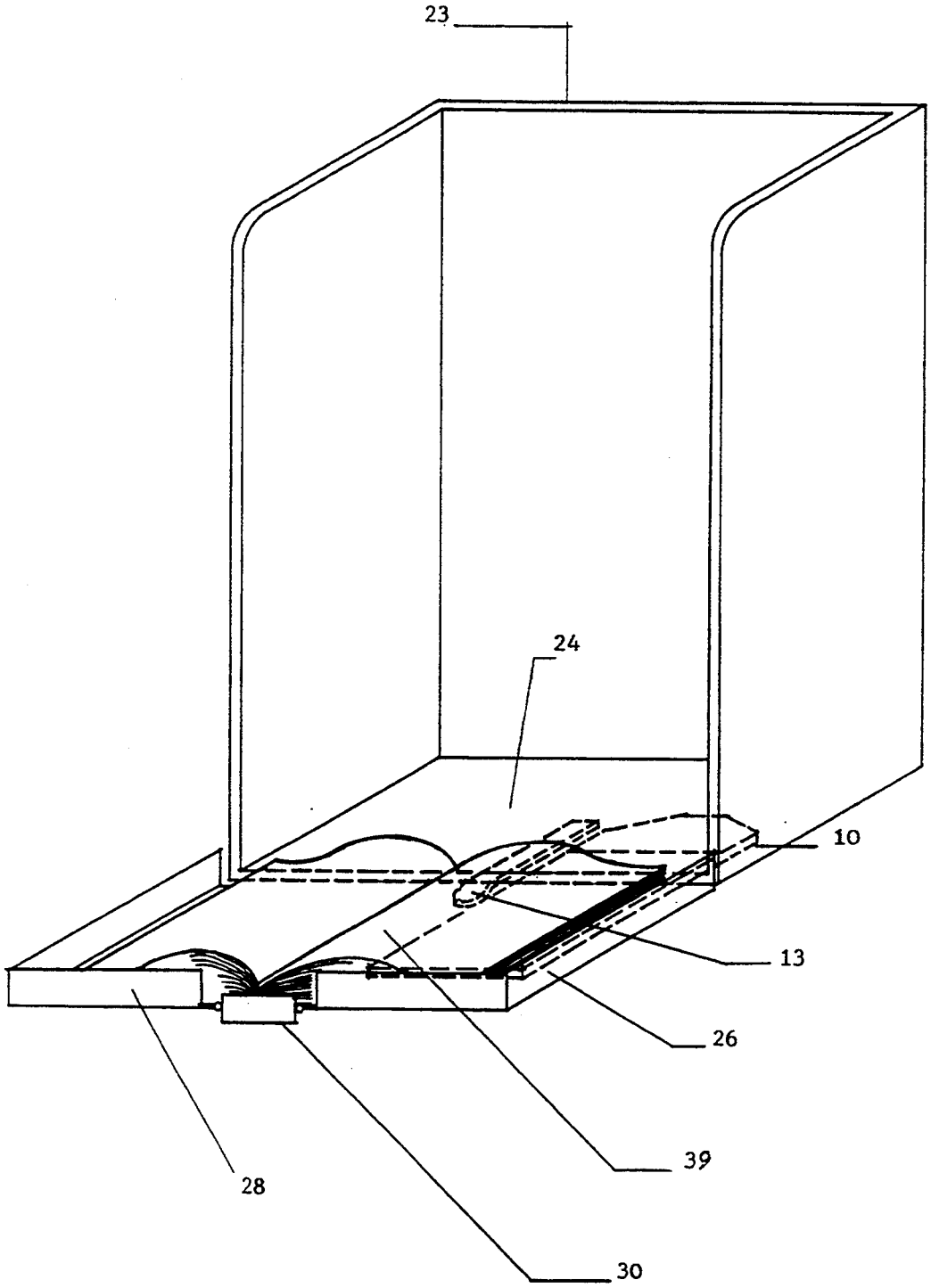
FIG. 2 is a perspective view of the enclosure with the binder open and being supported by the rest.

FIG. 5 shows details of base 10 and frame 12. In use hinge pin 22 is disposed in location 22A so that piston 15 engages with dashpot 14. Tongue 17 on seal 16 so shaped to interlock with groove 17A. When not in use, directory 39 in binder 21 is disposed below shelf 24 as shown in FIGS. 1 and 3. A person wishing to use directory 38 grasps binder 21 and lifts it upward and towards the front of shelf 24 until it is substantially in the horizontal position adjacent to rest 13. With one hand the user holds back cover 26 horizontal and with the other hand, opens binder 21 until it is fully open and back 30 of the binder is on top of rest 13 as shown in FIGS. 2 and 4. The user applies downward pressure on cover 28 which keeps the assembly in place so that the user can use the hand that was used to lift binder 21 to open the pages of directory 38 and to dial the telephone.

When released, the springs that bias hinges 32 and 34 close binder 21. The closing action is assisted by the downward pull of gravity on the holder. The directory assembly returns to the storage position at a speed controlled by piston 15 and dashpot 14.

During the lifting process of binder 21, piston 15 is withdrawn from dashpot 14. This creates a vacuum in the dashpot. The vacuum causes the outward edges of seal 16 to flex away from the face of piston 15 allowing air to enter dashpot 14 thus allowing the assembly to be easily raised. During the process of the assembly returning to the storage position, seal 16 is forced against piston 15 and the outward edges of seal 16 contact the walls of dashpot 14 and trap the air. The trapped air escapes from dashpot 14 through opening 18 which allows the assembly to return to storage at a controlled speed.

Thus the present invention has disclosed and described a novel means of displaying telephone directories which assures that the reference material will be unobtrusively stored when not in use and can be easily be accessed and held in place.

The preferred embodiment of the invention has been set forth herein. However, it is to be understood that variations may be made in such preferred embodiment, which variations may nevertheless be within the scope and spirit of the invention. The invention is therefore to be broadly construed, within the scope and spirit of the claims.

I claim:

1. A mechanical device in combination with a shelf having a bottom, top, and front, and a binder having back and side covers pivotable between an access and stored position, the device comprising:

a base attached to the bottom of the shelf, the base having a hinge means, the hinge axis being substantially parallel to front of the shelf and a sector shaped dashpot attached thereto, the dashpot extending generally perpendicularly to the hinge means, a frame having an edge, the edge hinged to the base, the frame having a sector shaped piston means having a face, the piston means engageable with the dashpot, and the frame is attached to the cover of the binder allowing the binder to be attached to the frame at 90 degrees from the hinge axis, a rest attached to the front of the shelf supporting the back cover of the binder when the binder is in the accessed position, and a flexible seal secured to the face of the piston means enabling the entrapment of air in the dashpot upon pivoting of the binder to the stored position and allowing the passage of air into the dashpot during the pivoting of the frame to the access position.

2. The device as in claim 1, the dashpot centered substantially in the center of the hinge means of the base and the back of the binder substantially at the edge 90 degrees from the hinge means.

3. The device as in claim 1, the seal having a means therein enabling the passage of air from the dashpot.

* * * * *